US011192011B1

(12) United States Patent
Gong

(10) Patent No.: US 11,192,011 B1
(45) Date of Patent: Dec. 7, 2021

(54) RELAY RACE TRAINING APPARATUS

(71) Applicant: Hunan Normal University, Hunan (CN)

(72) Inventor: Tao Gong, Hunan (CN)

(73) Assignee: HUNAN NORMAL UNIVERSITY, Changsha (CN)

( * ) Notice: Subject to any disclaimer, the term of this patent is extended or adjusted under 35 U.S.C. 154(b) by 0 days.

(21) Appl. No.: 17/334,732

(22) Filed: May 29, 2021

(30) Foreign Application Priority Data

May 29, 2020 (CN) ..... 202010476997.3

(51) Int. Cl.
*A63B 69/00* (2006.01)
*A63B 22/02* (2006.01)

(52) U.S. Cl.
CPC ..... *A63B 69/0028* (2013.01); *A63B 22/02* (2013.01)

(58) Field of Classification Search
CPC .. A63B 69/0028; A63B 22/02; G09B 19/0038
See application file for complete search history.

(56) References Cited

U.S. PATENT DOCUMENTS 4,149,724 A * 4/1979 Walsh ..... A63B 67/12 273/341.1
4,743,009 A * 5/1988 Beale ..... A63B 22/02 482/54
5,171,196 A * 12/1992 Lynch ..... A63B 21/154 482/54
5,873,783 A * 2/1999 McBain ..... A63B 21/072 463/47.7
6,093,119 A * 7/2000 Tipton ..... A63B 69/0053 273/451
6,500,097 B1 * 12/2002 Hall ..... A63B 19/04 482/51
6,740,009 B1 * 5/2004 Hall ..... A63B 19/04 434/59

(Continued)

FOREIGN PATENT DOCUMENTS

CN 203852820 U 10/2014
CN 104922887 B 8/2017
CN 207532679 U 6/2018

OTHER PUBLICATIONS

Search Report of 202010476997.3.

*Primary Examiner* — Sundhara M Ganesan
(74) *Attorney, Agent, or Firm* — Dragon Sun Law Firm, PC; Jinggao Li, Esq.

(57) ABSTRACT

The present disclosure relates to a physical training apparatus, and in particular to a relay race training apparatus. The relay race training apparatus includes a tread mill, a column disposed at a side of the tread mill through a linear driving device, a swinging device disposed on the column, and a catching and releasing device connected to the swinging device, wherein the swinging device is used to simulate swinging and turning over of the catching and releasing device by a baton passer or a baton receiver in a running process, the catching and releasing device includes a catching and releasing body, a holding groove for holding a baton is disposed on the catching and releasing body, a limiting plate for limiting the position of the baton and a driving mechanism for driving the limiting plate to move along the baton are disposed in the holding groove.

19 Claims, 11 Drawing Sheets

(56) References Cited

U.S. PATENT DOCUMENTS

| | | | | |
|---|---|---|---|---|
| 7,381,058 | B1 * | 6/2008 | Hayes, Sr. | A63C 19/062<br>434/255 |
| 9,126,094 | B1 * | 9/2015 | Davis | A63B 71/0622 |
| 9,868,042 | B1 * | 1/2018 | Leonard | A63B 69/0028 |
| 10,953,305 | B2 * | 3/2021 | Dalebout | A63B 22/0046 |
| 2001/0015123 | A1 * | 8/2001 | Nishitani | A63B 71/0686<br>84/615 |
| 2008/0001745 | A1 * | 1/2008 | Yarsa | A63B 71/06<br>340/572.1 |
| 2017/0348558 | A1 * | 12/2017 | Namiki | A63B 69/0028 |

* cited by examiner

RELAY RACE TRAINING APPARATUS

CROSS-REFERENCE TO RELATED APPLICATION

This application claims priority from the Chinese patent application 202010476997.3 filed May 29, 2020, the content of which are incorporated herein in the entirety by reference.

TECHNICAL FIELD

The present disclosure relates to a physical training apparatus, and in particular to a relay race training apparatus.

BACKGROUND

A relay race is a group event involving running skill and baton passing and receiving skills. For athletes, the baton passing and receiving skills are of great importance for competition results. Good baton passing and receiving skills may improve confidence between athletes, reducing a fault rate, and helping a group to achieve better results. However, poor baton passing and receiving skills of athletes will undoubtedly cause many unexpected negative effects on the competition. Therefore, competition results may even be cancelled in a case of severe faults.

At present, baton passing and receiving skills are generally trained one to one. In the one-to-one training, a training partner is required to have mature skills that are matched with or even better than those of a trainee. At the same time, the training partner needs to be familiar with physical ability of the trainee and is capable of providing correct evaluation and guidance to a training process of the trainee. However, it is very difficult to find a suitable training partner in actual training unless training is performed with a training team or a coach together before competition. In special circumstances, no training partner can be found. At this time, the athletes have to stop practicing baton passing and receiving skills, which is unfavorable for the athletes to take part in different competitions with good mentality.

In addition, at present, the training of baton passing and receiving skills can be only performed in a spacious place. For athletes having no indoor sports field, they cannot carry out training indoors in harsh environments such as raining. Further, during the training of baton passing and receiving skills, it is often required to run and stop and find position back and forth. Thus, running training cannot be carried out as well.

At present, the apparatuses for training baton passing and receiving skills in the market only makes improvement on batons without solving the above problems. Further, no matter which improved baton is used by the athletes for training, a hand feeling of the baton is always different from that of a standard baton, which is unfavorable for the athletes to be familiar with the handing feeling of the standard baton in order to have an optimal sports state during the competition.

SUMMARY

In order to solve the above technical problem, the present disclosure provides a relay race training apparatus which provides continuous reciprocating training of baton passing and receiving skills with an eye on running training indoors.

The relay race training apparatus of the present disclosure includes a tread mill, a column disposed at a side of the tread mill through a linear driving device, a swinging device disposed on the column, and a catching and releasing device connected with the swinging device. The swinging device is used to simulate swinging and turning over of the catching and releasing device by a baton passer and a baton receiver in a running process. The catching and releasing device includes a catching and releasing body, a holding groove for holding a baton is disposed on the catching and releasing body, limiting plates for limiting the position of the baton and driving mechanisms for driving the limiting plates to move along the baton are disposed in the holding groove in such a way that two groups of limiting plates and driving mechanisms are disposed in a left-right symmetry manner, an active rolling wheel is disposed at the bottom of the holding groove, and a sensing device for sensing whether the baton is in place and the position of the baton is further disposed in the holding groove.

Further, an elastic plate is disposed on the limiting plate and connected with the limiting plate through several springs, and a rolling body is disposed on the elastic plate.

Further, an included angle of a moving direction of the driving mechanism and a horizontal plane where an axis of the baton is located is 0-60°.

Further, the sensing device is a photoelectric switch disposed at both ends of the holding groove respectively.

Further, a guiding groove and a limiting plate hiding groove are disposed on the holding groove, the driving mechanism includes a third stepping motor disposed at an end of the guiding groove away from the baton, a sliding cylinder slidably cooperating with the guiding groove is disposed on the limiting plate, and a third nut block thread-connected with the third stepping motor is disposed in the sliding cylinder.

Further, the linear driving device includes a screw rod disposed at a side of the tread mill, a fourth stepping motor for driving the screw rod and a fourth nut block cooperating with the screw rod, a guide rail is disposed at a side of the tread mill, the screw rod is disposed in the guide rail, the fourth nut block is slidably disposed in the guide rail, and the bottom of the column is fixed on the fourth nut block.

Further, the swinging device includes an up-down sliding mechanism that may move up and down along the column, a horizontal rotation mechanism disposed on the up-down sliding mechanism and a vertical rotation mechanism disposed on the horizontal rotation mechanism, and the catching and releasing device is connected to an output end of the vertical rotation mechanism.

Further, the up-down sliding mechanism includes a sleeving sliding block slidably cooperating with the column, a nut installation groove is disposed at a side of the column, a second stepping motor is disposed in the column, an output shaft of the second stepping motor is disposed toward the linear driving device, and a second nut block that extends into the nut installation groove to be thread-connected with the second stepping motor is disposed on the sleeving sliding block.

Further, a circular groove is disposed at an outer side of the sleeving sliding block, the horizontal rotation mechanism includes a rotary ring rotatably disposed in the circular groove, a ring gear is disposed on the rotary ring, and a motor for driving the rotary ring to rotate and a driving gear that is disposed at an output end of the motor and engaged with the ring gear are disposed on the sleeving sliding block.

Further, a connecting rod is also disposed on the rotary ring, the vertical rotation mechanism is disposed at an end of the connecting rod away from the rotary ring, and the catching and releasing device is connected to the output end of the vertical rotation mechanism.

The present disclosure has the following beneficial effects. The linear driving device, the column, the swinging device and the catching and releasing device are disposed at a side of the tread mill, so that all-round training can be carried out in the training modes of baton passing and baton receiving on the tread mill. Further, by disposing the swinging device, the limiting plates, the driving mechanism, the sensing device and the rolling wheel, the baton passing and receiving training can be carried out continuously. That is, while running training is performed, rapid and reciprocating baton passing and receiving training can be performed. Therefore, the present disclosure has a simple overall structure which requires less refitting for the tread mill, thereby facilitating disposal and installation. By disposing the catching and releasing device connected to the output end of the swinging device, swing of the arm and the palm of the baton passer or the baton receiver holding or to hold a baton in a running process may be simulated so as to restore a real baton passing or receiving environment. At the same time, during switching of baton passing training and baton receiving training, a corresponding up-sweep pass or down-sweep pass exercise may be performed by turning over the catching and releasing device. Further, a speed of the tread mill and a swing amplitude of the swinging device may be set according to physical quality and baton passing and receiving skills of the athlete, so as to train the baton passing and receiving responses of the athlete in the special case. The cooperation of the catching and releasing device and the swinging device may enable the training apparatus to simulate up-sweep pass or down-sweep pass in the baton passing process or simulate up-sweep or down-sweep receiving in the baton receiving process, so as to improve both the training effect and the baton passing and receiving skills of the athlete during the actual competition. At the same time, for the training apparatus of the present disclosure, there is no need to make any modification to the baton or require the athlete to use the batons of different hand feel in training or before competition. In this case, the athlete may use a standard competition baton for training. The catching and releasing device includes the catching and releasing body on which the holding groove is disposed, which can improve baton passing stability and accuracy of the athlete during a baton pass training. The limiting plates are disposed in the holding groove to simulate a baton catching action of the palm. Two groups of limiting plates and driving mechanisms are oppositely disposed respectively, and the two groups of limiting plates and the rolling wheels realize triangular positioning, thereby greatly improving the limiting effect and the catching stability, and ensuring the training effect.

The disposal of the elastic plate on the limiting plate not only ensures that the catching and releasing device can effectively and stably limit the position of the baton when the baton enters the holding groove during the baton passing training, but also helps the athlete to pull out the baton from the elastic plate and the holding groove without damaging the training apparatus during the baton receiving training. In this case, the limiting stability of the catching and releasing device and the smoothness of pulling out the baton are improved.

By disposing the guiding groove and the sliding cylinder, an occupation space of the driving mechanism of the catching and releasing device is reduced. The limiting plate hiding groove is disposed on the holding groove so that the limiting plate is hidden at a side wall of the holding groove when the limiting plate goes away from the baton. In this case, the limiting plate will not block the entry of the baton when the baton is placed into the holding groove during the baton passing training.

The swinging device of the present disclosure features reasonable design and compact structure. Further, the up-down sliding mechanism, the horizontal rotation mechanism and the vertical rotation mechanism are connected sequentially so that the structure is simplified and multiple swing modes can be simulated.

Figure 1:
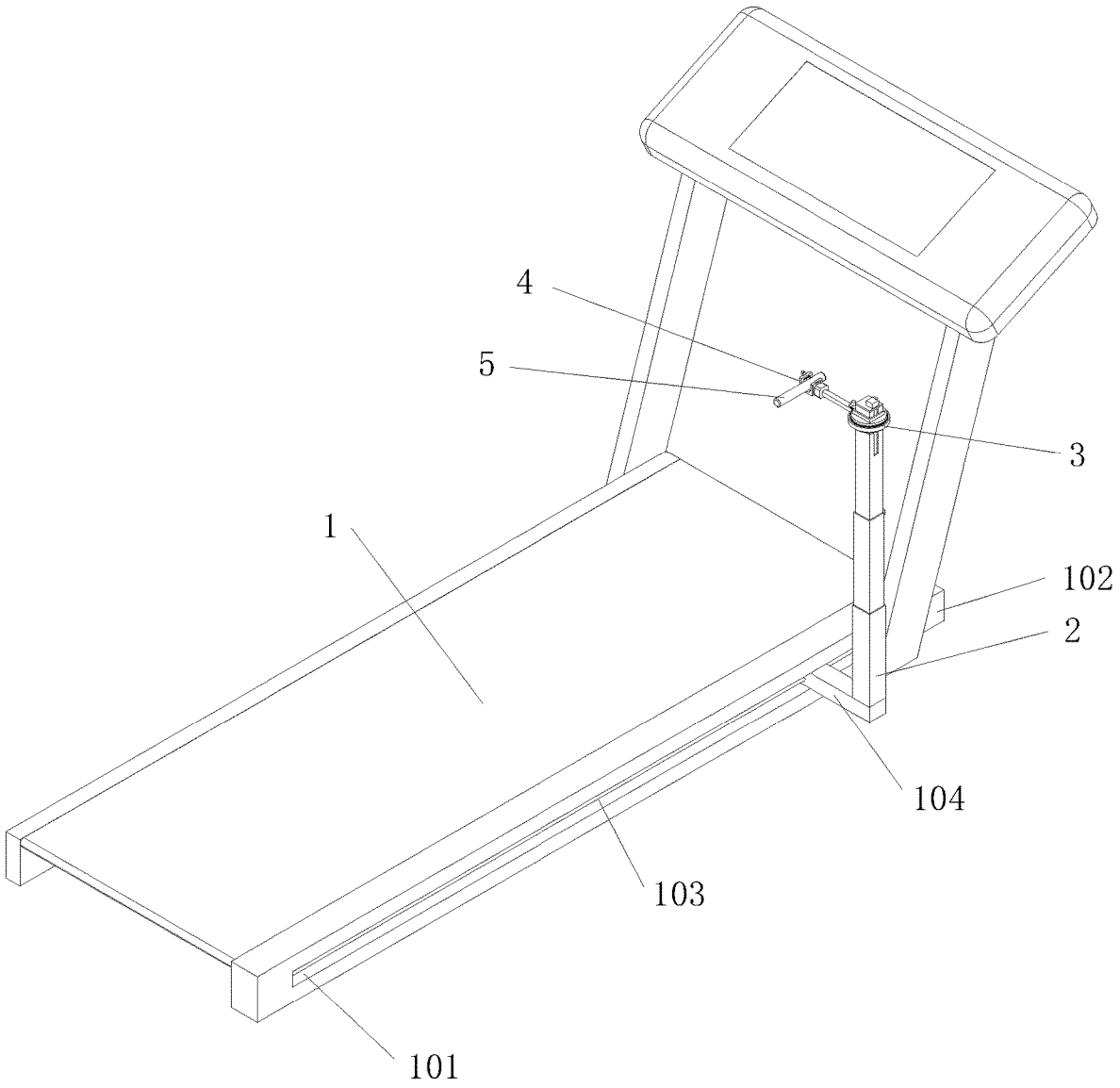
FIG. 1 is a schematic diagram of baton passing training according to an example of the present disclosure.

Numerals of the drawings are described as follows: 1-tread mill; 101-guide rail; 102-fourth stepping motor; 103-screw rod; 104-fourth nut block; 2-column; 201-first sleeve; 202-second sleeve; 203-third sleeve; 204-top plate; 205-first stepping motor; 206-first nut block; 207-nut installation groove; 3-swinging device; 301-up-down sliding mechanism; 3011-sleeving sliding block; 3012-circular groove; 3013-gap; 3014-second stepping motor; 3015-second nut block; 302-horizontal rotation mechanism; 3021-rotary ring; 3022-ring gear; 3023-motor; 3024-driving gear; 303-connecting rod; 304-vertical rotation mechanism; 3041-rotary motor; 4-catching and releasing device; 401-catching and releasing body; 402-holding groove; 403-rolling wheel; 404-limiting plate; 405-sliding cylinder; 406-third nut block; 407-guiding groove; 408-third stepping motor; 409-spring; 410-elastic plate; 411-rolling body; 412-photoelectric switch; 413-limiting plate hiding groove; and 5-baton.

DETAILED DESCRIPTION OF THE EMBODIMENTS

As shown in FIGS. 1-10, the present disclosure includes a tread mill 1, a column 2 disposed at a side of the tread mill 1 through a linear driving device, a swinging device 3 disposed on the column 2, and a catching and releasing device 4 connected with the swinging device 3. The swinging device 3 is used to simulate swinging and turning over of the catching and releasing device 4 by a baton passer or a baton receiver in a running process. The catching and releasing device 4 includes a catching and releasing body 401, a holding groove 402 for holding a baton 5 is disposed on the catching and releasing body 401, limiting plates 404 for limiting the position of the baton and driving mechanisms for driving the limiting plates 404 to move along the baton 5 are disposed in the holding groove in such a way that two groups of limiting plates 404 and driving mechanisms are disposed in a left-right symmetry manner, a rolling wheel 403 is disposed at the bottom of the holding groove 402, and a sensing device for sensing whether the baton 5 is in place and the position of the baton 5 is further disposed in the holding groove 402.

Figure 2:
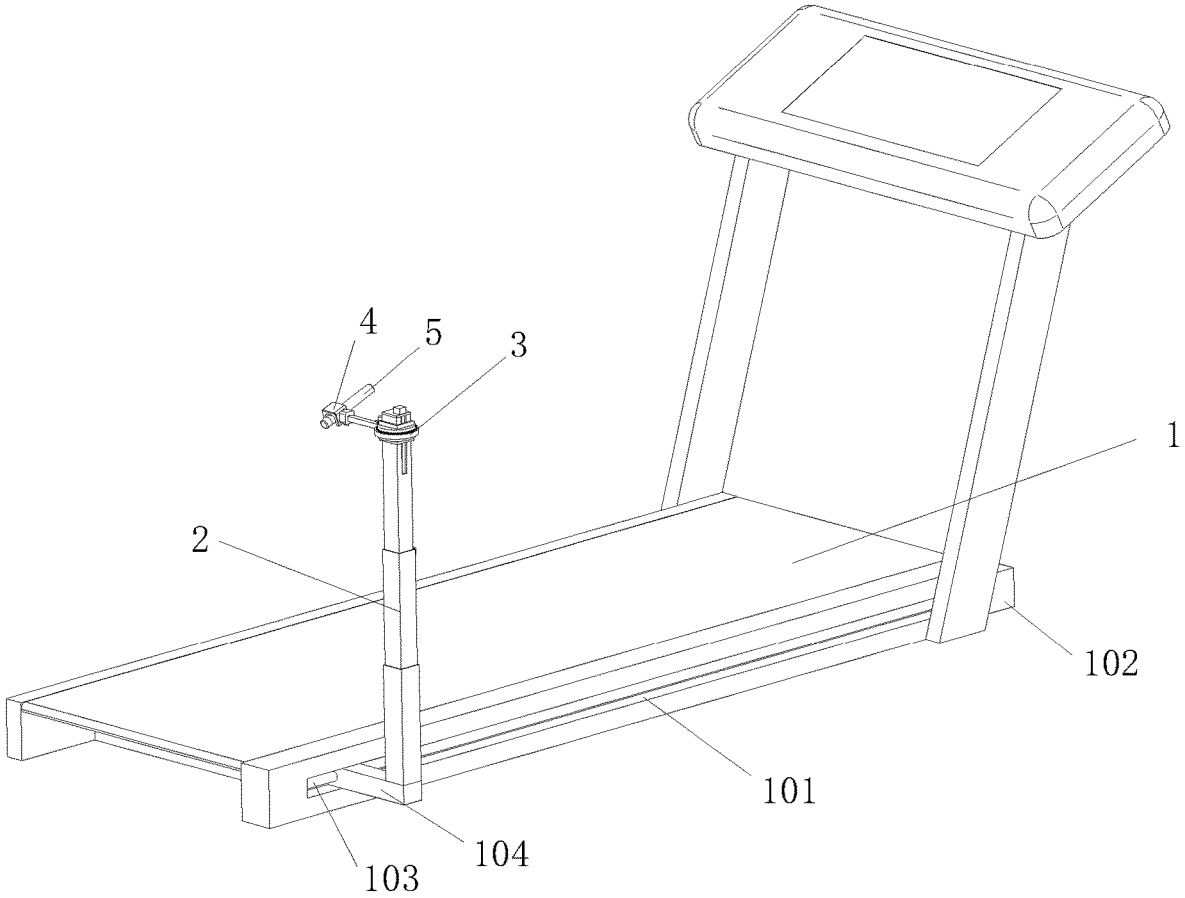
FIG. 2 is a schematic diagram of baton receiving training according to an example of the present disclosure.
Figure 3:
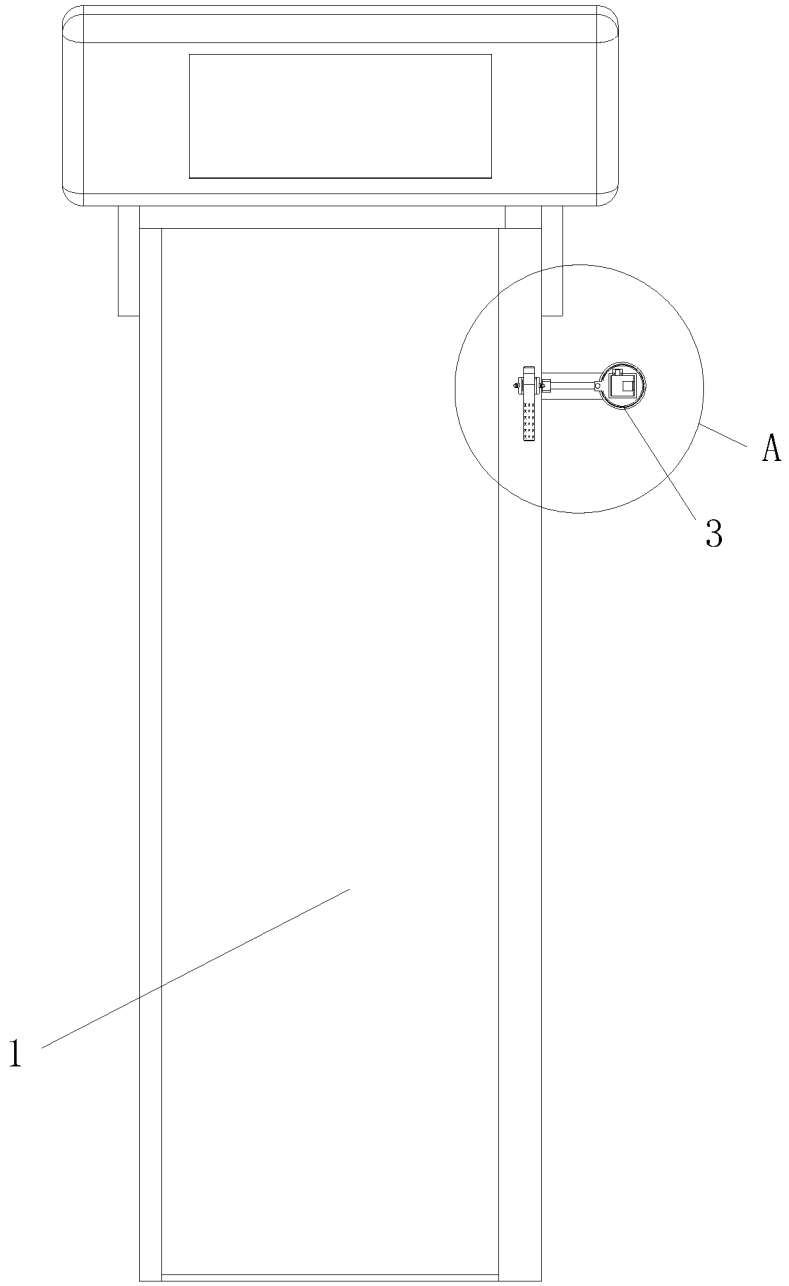
FIG. 3 is a top view of the present disclosure.

The present disclosure may provide baton passing training and baton receiving training for athletes to cover all skill exercises in relay races. During the baton passing training, as shown in FIG. 1, the column 2 is moved to a front end of the tread mill 1 through the linear driving device, and the swinging device 3 is started to simulate swing of the palm and the arm of an athlete during running; the athlete holding the baton 5 runs on the tread mill 1 while training himself to accurately and stably place the baton 5 into the catching and releasing device 4, so as to carry out the baton passing training of the baton 5. During the baton receiving training, as shown in FIG. 2, the column 2 is moved to a rear end of the tread mill 1, the baton 5 is fixed in the catching and releasing device 4, and the swinging device 3 is started to simulate the swing of the palm and the arm of the athlete during running; the athlete runs on the tread mill 1 while training himself to accurately and stably pull out the baton 5 in the catching and releasing device 4 from behind, so as to carry out the baton receiving training of the baton 5.

Figure 8:
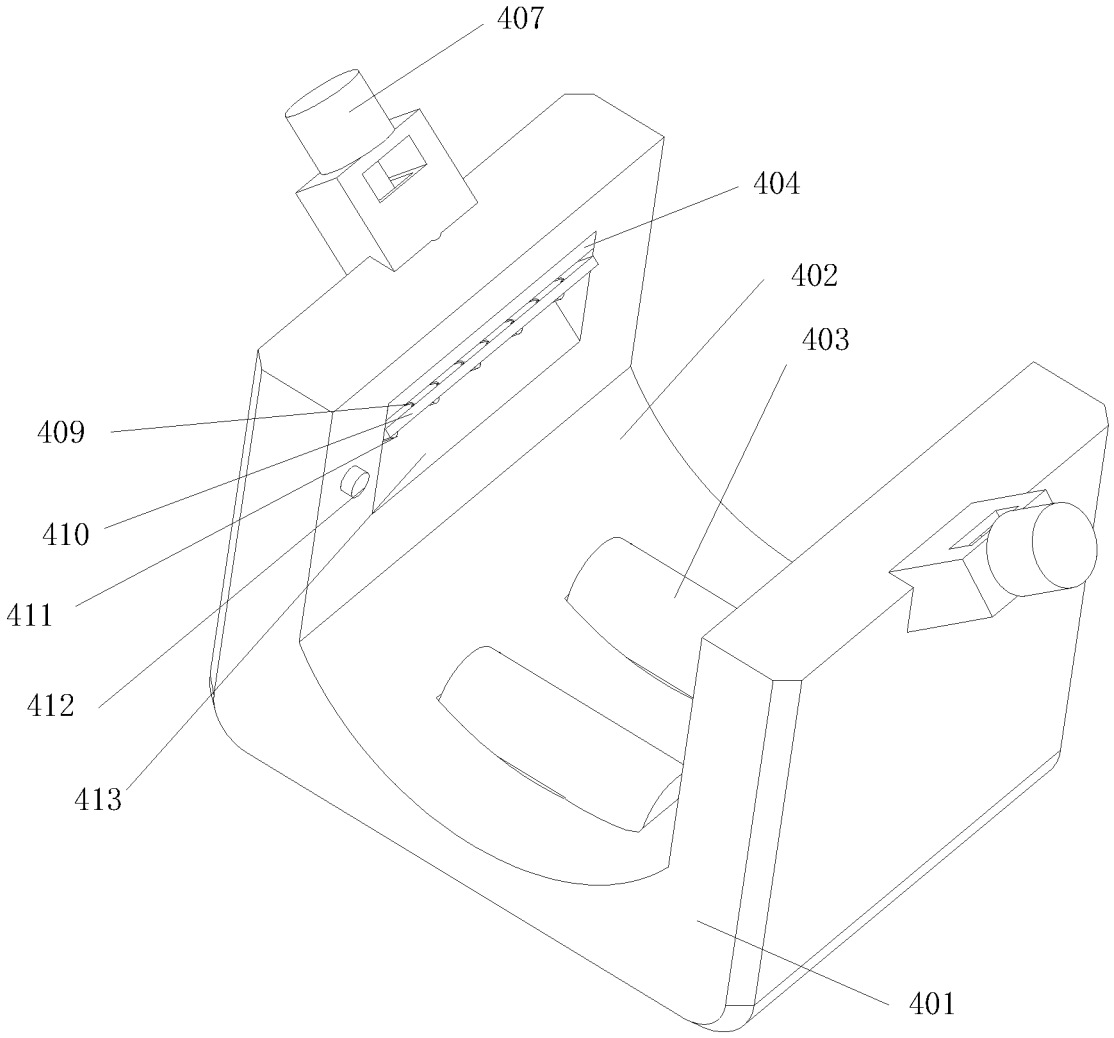
FIG. 8 is a schematic diagram of a structure of a catching and releasing device according to an example of the present disclosure.

In the present disclosure, the rolling wheel 403 is used to adjust the position of the baton 5 in the holding groove 402. In this case, when the athlete does not correctly place the baton 5 into the correct position of the holding groove 402 during the baton passing training, the rolling wheel 403 rotates to move the baton 5 along the holding groove 402. In this example, the rolling wheel 403 has a certain frictional force on its surface. As shown in FIG. 8, two rolling wheels 403 are preferably disposed to further improve a rolling efficiency.

In the present disclosure, by disposing the swinging device 3, the limiting plate 404, the driving mechanism, the sensing device and the rolling wheel 403, the baton passing training and the baton receiving training can be continuously carried out so as to perform reciprocating baton passing and receiving trainings with an eye on the running training. During the baton passing training, after the athlete places the baton 5 into the holding groove 402, the sensing device in the holding groove 402 senses the entry of the baton 5 and the driving mechanism is controlled to drive the limiting plates to limit the position of the baton 5, and thus the baton 5 is fixed in the catching and releasing device 4. The linear driving device moves the column 2, the swinging device 3 and the catching and releasing device 4 holding the baton 5 to the rear side of the tread mill 1. At the same time, the rolling wheel 403 rotates to drive the baton 5 to an end of the holding groove 402 until the sensing device determines that the baton 5 is in a correct position, so as to help the athlete to pull out the baton. At the same time, the swinging device 3 turns over the catching and releasing device 4 to enable an opening of the holding groove 402 to face forward and downward, so as to complete preparation of the baton receiving training. Then, the athlete performs the baton receiving training. After the baton receiving training is performed, the linear driving device moves the column 2, the swinging device 3 and the catching and releasing device 4 without the baton 5 to the front side of the tread mill 1. In this way, the above process is repeated to rapidly perform the running training and the baton passing and receiving training simultaneously.

During the baton passing training or the baton receiving training, the linear driving device may further drive the column 2, the swinging device 3 and the catching and releasing device 4 to move forward or backward for a short distance, so as to simulate the baton passing training or the baton receiving training in which the baton receiver and the baton passer have different speeds in a baton receiving zone. The athlete may adjust a swing radian of the swinging device 3 to an amplitude suitable for himself.

The tread mill 1 may be an ordinary tread mill for which only a linear driving device is provided at a side of the tread mill, or may be a tread mill that may automatically adjust its speed according to a running speed to facilitate the running training of the athlete, or may be an unpowered arc-shaped tread mill to help the athlete to practice extreme running.

An elastic plate 410 is disposed on the limiting plate 404 and connected with the limiting plate 404 through several springs 409. The disposal of the elastic plate 410 on the limiting plate 404 ensures that the position of the baton 5 is effectively and stably limited when the baton 5 enters the holding groove 402 during the baton passing training and also helps the athlete to pull out the baton 5 from the elastic plate 410 and the holding groove 402 during the baton receiving training. Therefore, the limiting stability of the catching and releasing device 4 and the smoothness of pulling out the baton 5 are improved. A rolling body 411 is disposed on the elastic plate 410 to improve sliding smoothness of the baton 5 in the holding groove 402.

Figure 7:
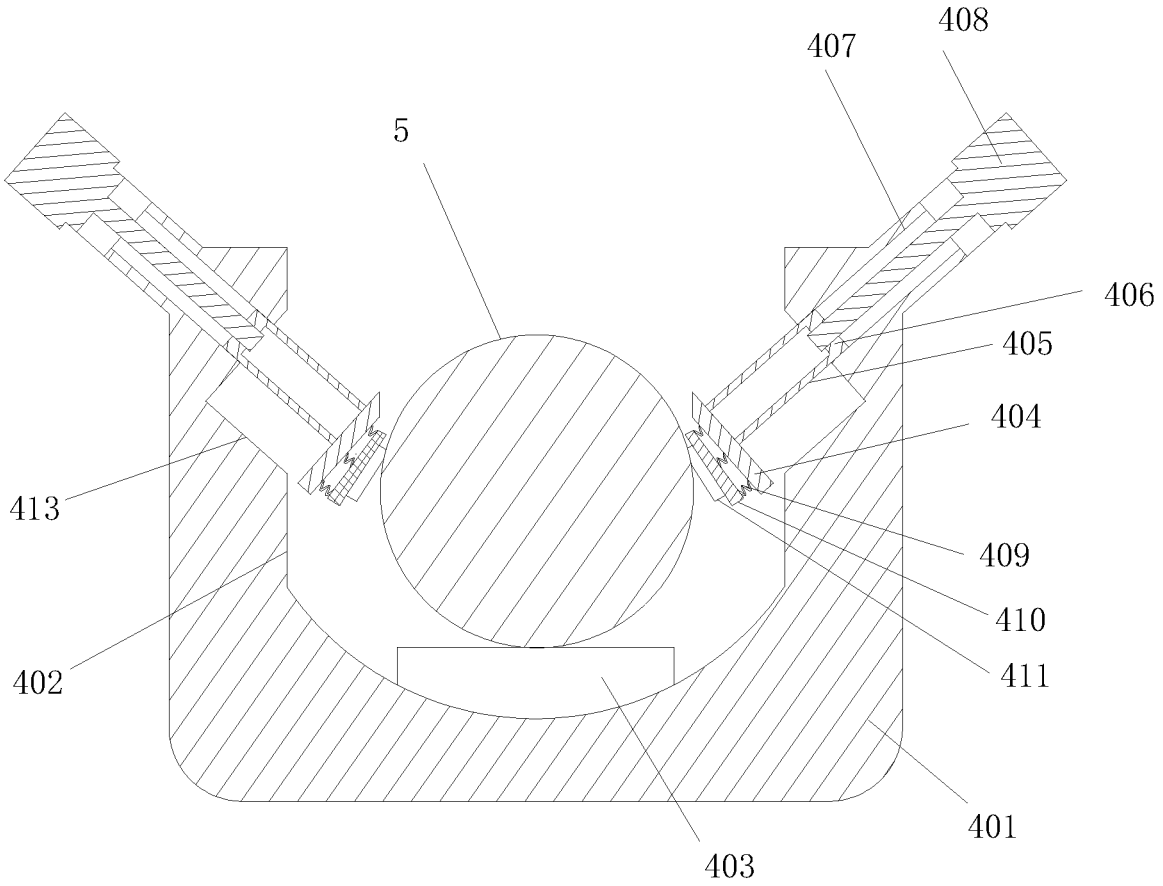
FIG. 7 is a sectional view of D-D in FIG. 4.

As shown in FIG. 7, two groups of limiting plates 404 and driving mechanisms are disposed in a left-right symmetry manner. The driving mechanism and the limiting plate 404 are located above a horizontal plane where an axis of the baton 5 is located, and an included angle of a moving direction of the driving mechanism and the horizontal plane where the axis of the baton is located is 0-60°.

The sensing device is a photoelectric switch 412 disposed at both ends of the holding groove 402 respectively. Both photoelectric switches 412 include a photoelectric transmitter and a photoelectric receiver disposed at opposing sides of the holding groove 402. When the baton passing training is performed, two photoelectric switches 412 sense presence of the baton 5 in the holding groove 402, and then, the driving mechanism rapidly responses to drive the limiting plates 404 to limit the position of the baton 5 for automatic limiting, thereby improving device automation and practicability. After the limiting is completed, the rolling wheel 403 rotates to drive the baton 5 to move along the holding groove 402 until the transmitter and the receiver of the photoelectric switch 412 at one side of the holding groove are conducted, which indicates that one end of the baton 5 reaches a limit position. Then, the rolling wheel 403 stops rotating and the position of the baton 5 is sensed. Thus, the sensing device can sense whether the baton 5 enters and adjust the position of the baton 5 in cooperation with the rolling wheel 403 simultaneously. During the baton receiving training, after the athlete pulls out the baton 5, the transmitter and the receiver of the photoelectric switch 412 at the other side of the holding groove are conducted to determine that the baton 5 is pulled out. At the same time, the limiting plates 404 are reset, and the column 2, the swinging device 3 and the catching and releasing device 4 are moved to the front end of the tread mill 1. The rolling wheel 403 is driven by a motor disposed in the catching and releasing body 401 (not shown).

A guiding groove 407 is disposed on the holding groove 402. The driving mechanism includes a third stepping motor 408 disposed at an end of the guiding groove 407 away from the baton 5, a sliding cylinder 405 slidably cooperating with the guiding groove 407 is disposed on the limiting plate 404, and a third nut block 406 thread-connected with the third stepping motor 408 is disposed in the sliding cylinder 405. The driving mechanism is a stepping motor with sensitive response and high precision. By disposing the guiding groove 407 and the sliding cylinder 405, the occupation space of the driving mechanism is reduced. A limiting plate hiding groove 413 is disposed on the holding groove 402 so that the limiting plate 404 is hidden at a side wall of the holding groove 402 when the limiting plate 404 goes away from the baton. In this way, it is ensured that the limiting plate 404 will not block the entry of the baton 5 when the baton 5 is placed into the holding groove 402 during the baton passing training.

The linear driving device of the present disclosure may be an air cylinder, a hydraulic cylinder or a linear module. In this example, the linear driving device includes a screw rod 103 disposed at a side of the tread mill 1, a fourth stepping motor 102 for driving the screw rod 103 and a fourth nut block 104 cooperating with the screw rod 103. A guide rail 101 is disposed at a side of the tread mill 1, the screw rod 103 is disposed in the guide rail 101, and the fourth nut block 104 is slidably disposed in the guide rail 101. In this example, the fourth stepping motor 102 is disposed at an end of the tread mill 1. The linear driving device of the present disclosure adopts the linear module for driving, which features simple structure, simple disposal and fast response. The bottom of the column 2 is fixed on the fourth nut block 104. In this example, the other end of the fourth nut block 104 extends out of the guide rail 101 and has a certain distance from an outer side of the guide rail 101 to enable the column 2 to go away from a side of the tread mill 1, and make those parts other than the catching and releasing device 4 away from the tread mill as possible in cooperation with the connecting rod 303. In this way, the arm of the athlete will be prevented from bumping the column 2 and the swinging device 3 during running.

Figure 9:
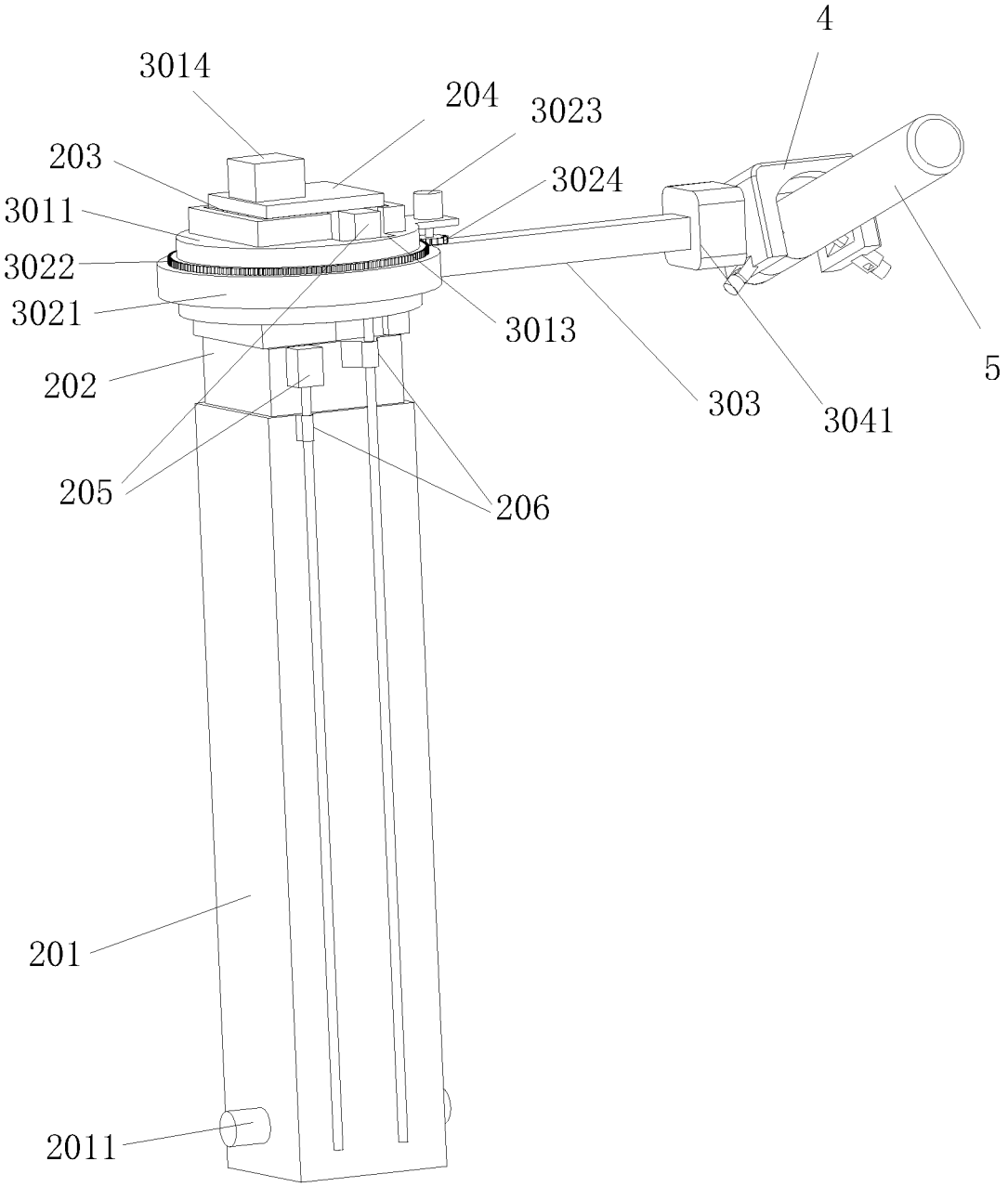
FIG. 9 is a schematic diagram of a partial structure of the present disclosure.
Figure 10:
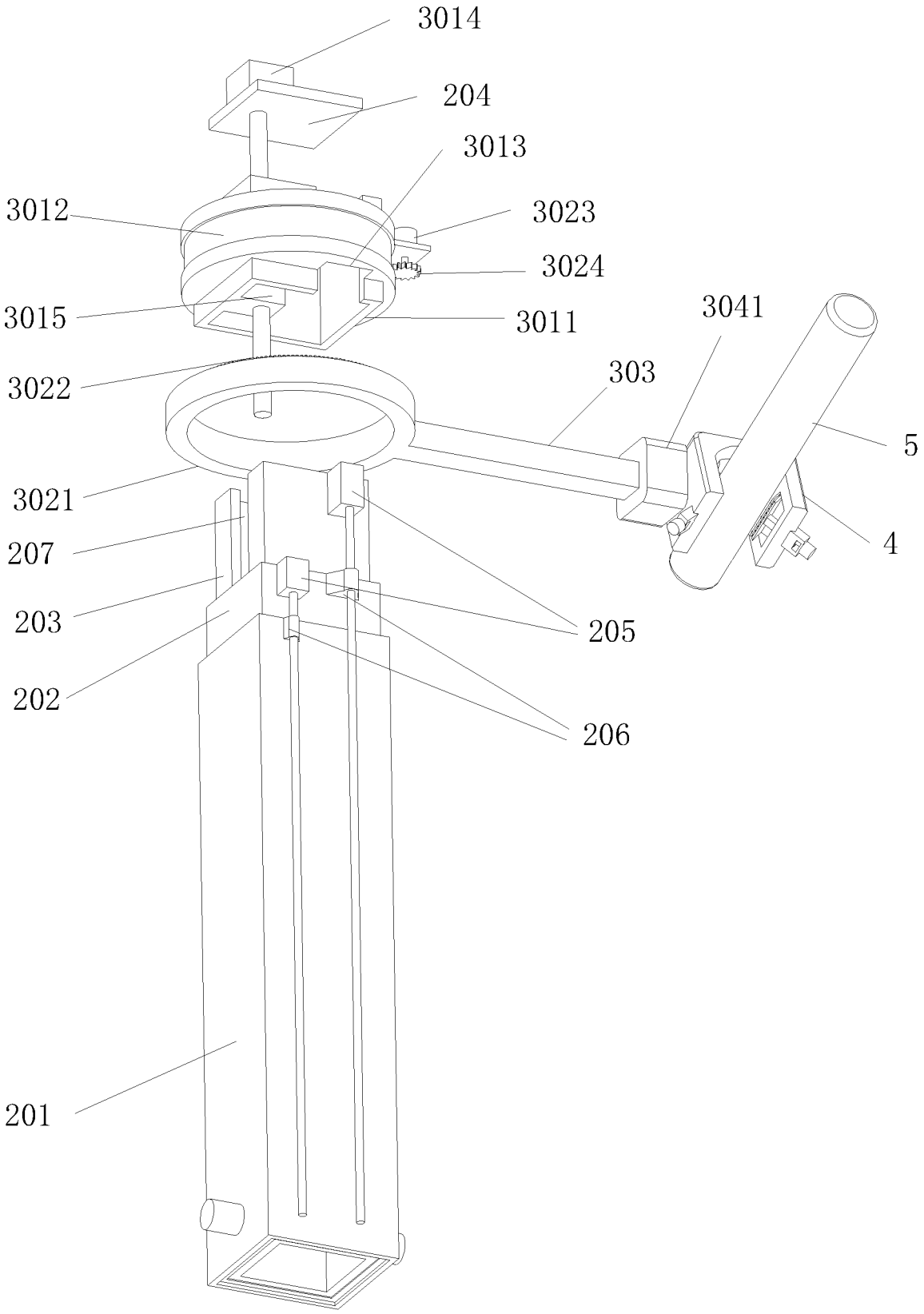
FIG. 10 is an exploded schematic view of a partial structure of the present disclosure.

As shown in FIG. 9 and FIG. 10, the column 2 is a multi-section telescopic rod on which a lifting driving device is disposed. The column 2 is disposed as the multi-section telescopic rod to facilitate adjusting heights of the swinging device 3 and the catching and releasing device 4, so as to adapt to heights of different athletes. In addition, a swing amplitude larger than the swinging device 3 may also be simulated in the training process so as to simulate an extreme case in the training process. In this example, the telescopic rod has three sections, that is, a first sleeve 201, a second sleeve 202 and a third sleeve 203 which are sleeved with one another. The lifting driving device includes two first stepping motors 205 and two first nut blocks 206 for driving. The two first stepping motors 205 are disposed at the tops of the second sleeve 202 and the third sleeve 203 respectively, and the two first nut blocks 206 are disposed at the tops of the first sleeve 201 and the second sleeve 202 respectively, so as to drive three sections of telescopic rods. Therefore, the automation of the device is improved and the simulation of higher swing amplitude is realized. In this example, a gap 3013 for providing an installation position for the first stepping motor 205 is also disposed on the sleeving sliding block 3011.

Figure 4:
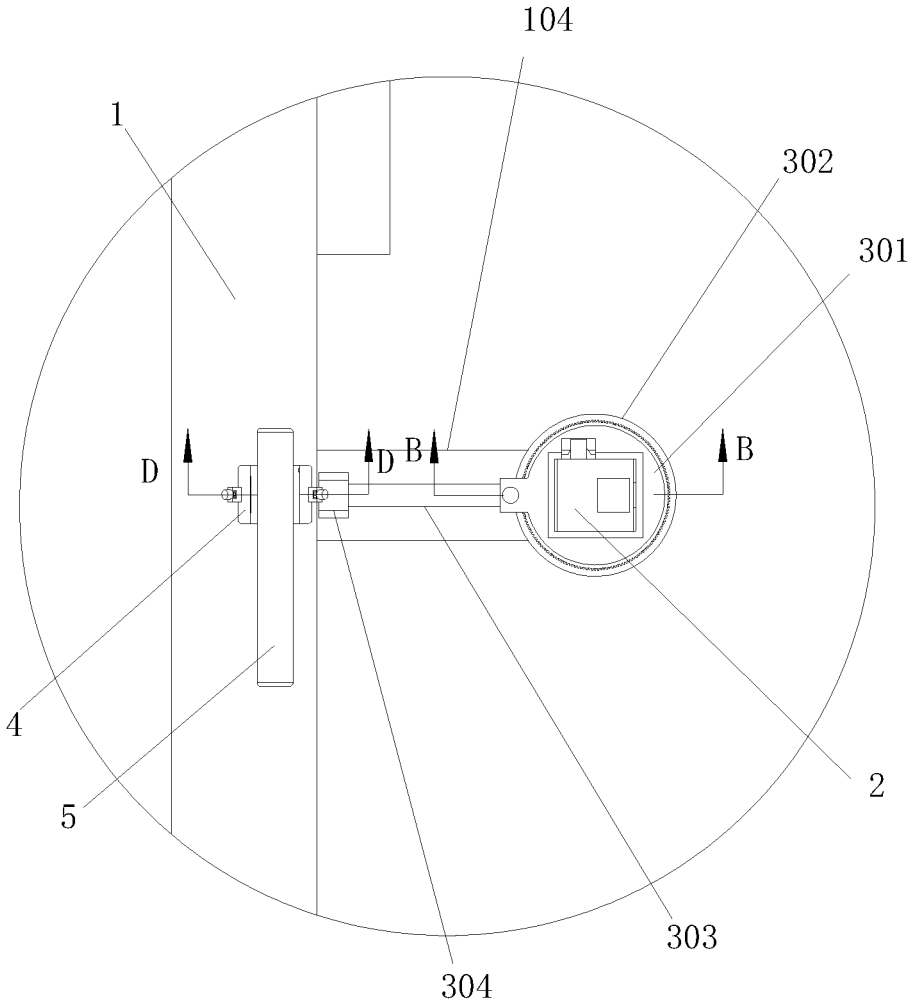
FIG. 4 is a partial enlarged view of position A in FIG. 3.
Figure 5:
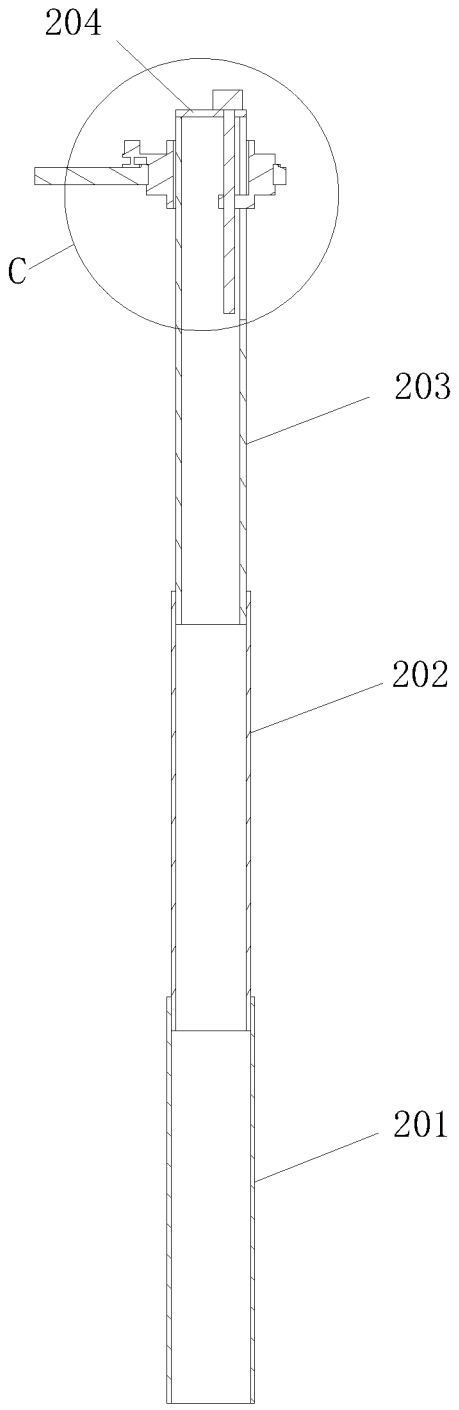
FIG. 5 is a sectional view of B-B in FIG. 4.
Figure 6:
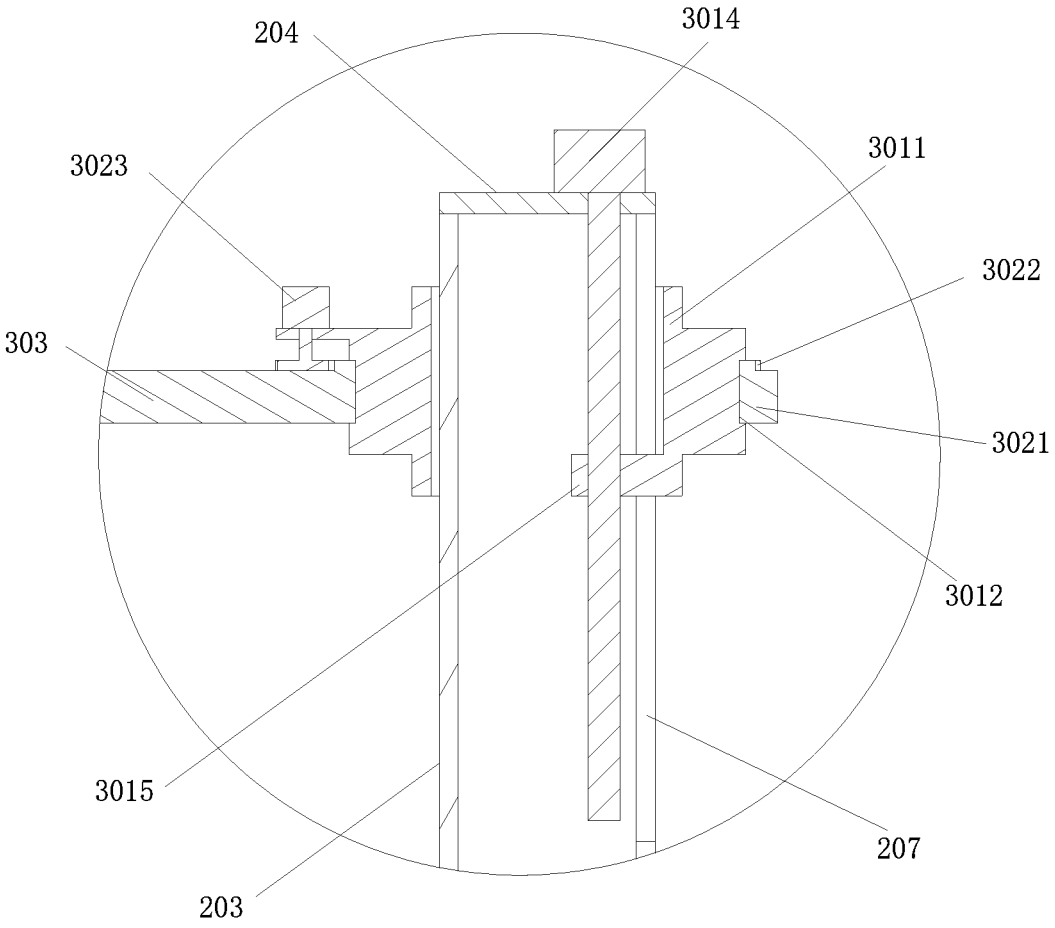
FIG. 6 is a partial enlarged view of position C in FIG. 5.

The swinging device 3 includes an up-down sliding mechanism 301 movable up and down along the linear driving device, a horizontal rotation mechanism 302 disposed on the up-down sliding mechanism 301 and a vertical rotation mechanism 304 disposed on the horizontal rotation mechanism 302. The up-down sliding mechanism 301 includes a sleeving sliding block 3011 slidably cooperating with the third sleeve 203, a nut installation groove 207 is disposed on the third sleeve 203, a second stepping motor 3014 is disposed in the telescopic rod, an output shaft of the second stepping motor 3014 is disposed toward the linear driving device, a second nut block 3015 that extends into the nut installation groove 207 to be thread-connected with the second stepping motor 3014 is disposed on the sleeving sliding block 3011, and the second stepping motor 3014 and the second nut block 3015 are used to drive the up-down sliding mechanism 301 to slide up and down. In this example, a top plate 204 is disposed at an end of the third sleeve 203 and used to provide an installation space for the second stepping motor 3014. The second stepping motor 3014 and the second nut block 3015 are disposed inside the third sleeve 203 through the top plate 204 and the nut installation groove 207, thereby greatly reducing the occupation space of the up-down sliding mechanism 301. As shown in FIG. 4 and FIG. 10, a circular groove 3012 is disposed at an outer side of the sleeving sliding block 3011, the horizontal rotation mechanism 302 includes a rotary ring 3021 rotatably connected with the circular groove 3012, a ring gear 3022 is disposed at an upper end of the rotary ring 3021, and a motor 3023 for driving the rotary ring 3021 to rotate and a driving gear 3024 that is disposed at an output end of the motor 3023 and engaged with the ring gear 3022 are disposed on the sleeving sliding block 3011. To enable the catching and releasing device 4 to be relatively away from the tread mill 1 and facilitate baton passing or baton receiving of the athlete, the connecting rod 303 is also disposed on the rotary ring 3021. The vertical rotation mechanism 304 is disposed at an end of the connecting rod 303 away from the rotary ring 3021. The column 2, the fourth nut block 104 and the connecting rod 303 substantially are together shaped like "]". The vertical rotation mechanism 304 is preferably provided with a rotary motor 3041, is disposed. As shown in FIG. 1 and FIG. 2, the vertical rotation mechanism 304 is disposed so that the direction of the catching and releasing device 4 may be changed. During the baton passing training, the opening of the holding groove 402 of the catching and releasing device 4 is faced upward to realize down-sweep baton passing training. Similarly, the opening of the holding groove 402 may also be faced downward to realize up-sweep baton passing training. On the contrary, during the baton receiving training, the opening of the holding groove 402 of the catching and releasing device 4 is faced upward to realize up-sweep baton receiving training, and the opening of the holding groove 402 is faced downward to realize down-sweep baton receiving training. The catching and releasing body 401 of the catching and releasing device 4 is connected to the output end of the vertical rotation mechanism 304.

Figure 11:
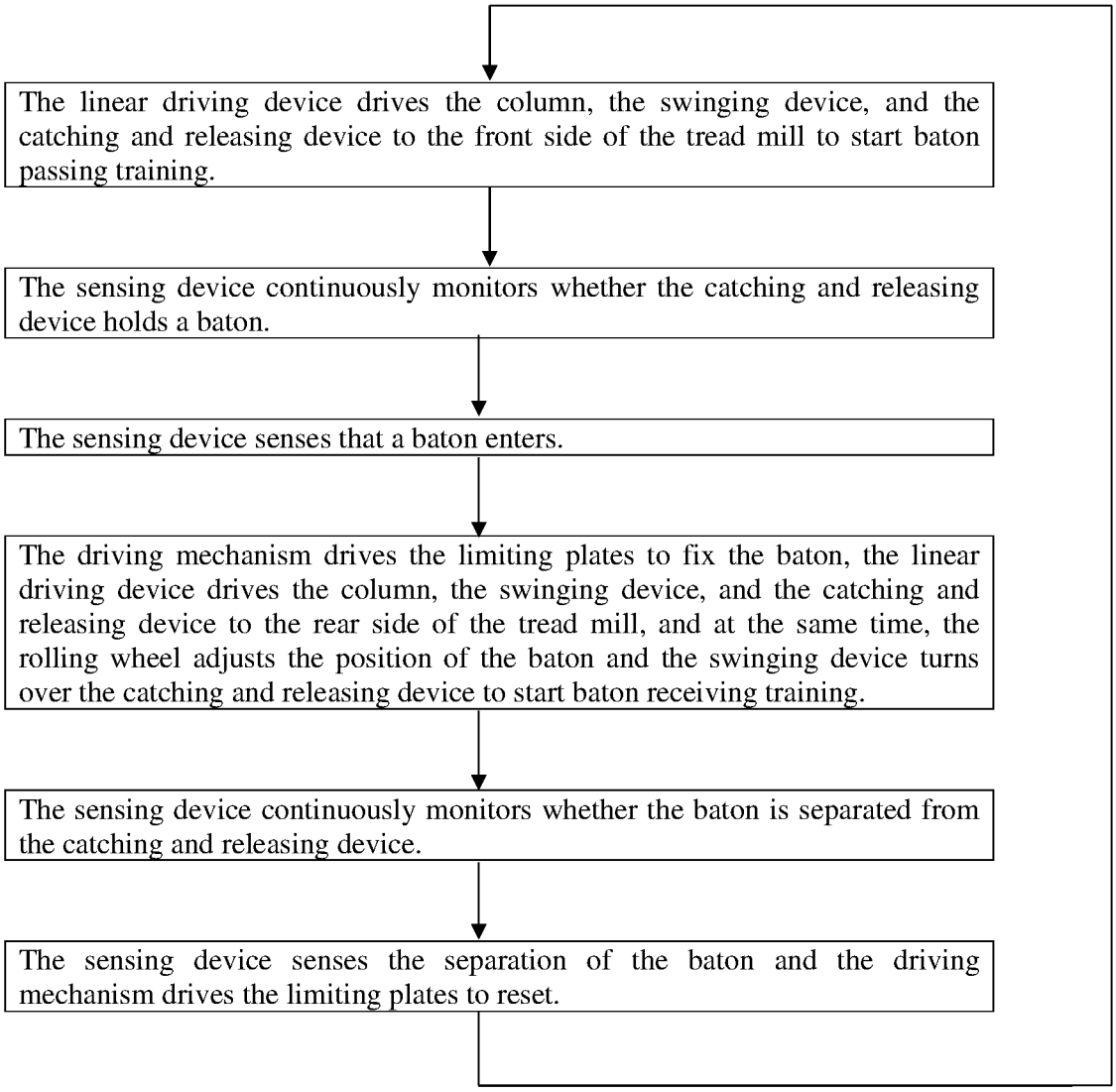
FIG. 11 is a training flowchart of the present disclosure.

The training flow of the present disclosure is as shown in FIG. 11. When the down-sweep baton passing training is performed, the column 2, the swinging device 3 and the catching and releasing device 4 are all located at the front side of the tread mill 1, the opening of the holding groove 402 faces upward, and two photoelectric switches 412 in the holding groove 402 of the catching and releasing device 4 perform continuous monitoring. When the athlete places the baton 5 into the holding groove 402, the transmitters and the receivers of two photoelectric switches 412 are disconnected, the sensing device determines that the baton 5 enters, and the driving mechanism drives the limiting plates 404 to fix the baton 5. Then, the linear driving device drives the column 2, the swinging device 3 and the catching and releasing device 4 to move to the rear side of the tread mill 1 after the baton 5 is fixed. In the moving process, the rolling wheel 403 rotates to drive the baton 5 to move along the holding groove 402 until the transmitter and the receiver of one photoelectric switch 412 are conducted. Then, the rolling wheel 403 stops rolling to complete adjusting the position of the baton 5. At the same time, the vertical rotation mechanism 304 of the swinging device 3 turns over the catching and releasing device 4 to enable the opening of the holding groove 402 to face downward, so as to complete preparation of the down-sweep baton receiving training and start the baton receiving training After the athlete pulls out the baton 5 from behind, the transmitter and the receiver of the other photoelectric switch 412 are conducted, the sensing device determines that the baton 5 is separated from the catching and releasing device 4, and the driving mechanism drives the limiting plates 404 to reset. The vertical rotation mechanism 304 of the swinging device 3 turns over the catching and releasing device 4 to enable the opening of the holding groove 402 to face upward, so that the linear driving device finally moves the column 2, the swinging device 3 and the catching and releasing device 4 to the front side of the tread mill to prepare the down-sweep baton passing training, and so on.

What is claimed is:

1. A relay race training apparatus, comprising a tread mill (1), a column (2) disposed at a side of the tread mill (1) through a linear driving device, a swinging device (3) disposed on the column (2), and a catching and releasing device (4) connected to the swinging device (3), wherein the swinging device (2) is used to simulate swinging and turning over of the catching and releasing device (4) by a baton passer or a baton receiver in a running process, the catching and releasing device (4) comprises a catching and releasing body (401), a holding groove (402) for holding a baton (5) is disposed on the catching and releasing body (401), limiting plates (404) for limiting the position of the baton (5) and driving mechanisms for driving the limiting plates (404) to move along the baton (5) are disposed in the holding groove (402) so that two groups of limiting plates (404) and driving mechanisms are disposed in a left-right symmetry manner, a rolling wheel (403) is disposed at the bottom of the holding groove (402), and a sensing device for sensing whether the baton (5) is in place and the position of the baton (5) is further disposed in the holding groove (402).

2. The relay race training apparatus according to claim 1, wherein an elastic plate (410) is disposed on the limiting plate (404) and connected to the limiting plate (404) through several springs (409), and a rolling body (411) is disposed on the elastic plate (410).

3. The relay race training apparatus according to claim 2, wherein a guiding groove (407) and a limiting plate hiding groove (413) are disposed on the holding groove (402), the driving mechanism comprises a third stepping motor (408) disposed at an end of the guiding groove (407) away from the baton (5), a sliding cylinder (405) slidably cooperating with the guiding groove (407) is disposed on the limiting plate (404), and a third nut block (406) thread-connected with the third stepping motor (408) is disposed in the sliding cylinder (405).

4. The relay race training apparatus according to claim 2, wherein the linear driving device comprises a screw rod (103) disposed at a side of the tread mill (1), a fourth stepping motor (102) for driving the screw rod (103) and a fourth nut block (104) cooperating with the screw rod (103), a guide rail (101) is disposed at a side of the tread mill (1), the screw rod (103) is disposed in the guide rail (101), the fourth nut block (104) is slidably disposed in the guide rail (101), and the bottom of the column (2) is fixed on the fourth nut block (104).

5. The relay race training apparatus according to claim 2, wherein the swinging device (3) comprises an up-down sliding mechanism (301) movable up and down along the column (2), a horizontal rotation mechanism (302) disposed on the up-down sliding mechanism (301) and a vertical rotation mechanism (304) disposed on the horizontal rotation mechanism (302), and the catching and releasing device (4) is connected to an output end of the vertical rotation mechanism (304).

6. The relay race training apparatus according to claim 1, wherein an included angle of a moving direction of the driving mechanism and a horizontal plane where an axis of the baton (5) is located is 0-60°.

7. The relay race training apparatus according to claim 6, wherein a guiding groove (407) and a limiting plate hiding groove (413) are disposed on the holding groove (402), the driving mechanism comprises a third stepping motor (408) disposed at an end of the guiding groove (407) away from the baton (5), a sliding cylinder (405) slidably cooperating with the guiding groove (407) is disposed on the limiting plate (404), and a third nut block (406) thread-connected with the third stepping motor (408) is disposed in the sliding cylinder (405).

8. The relay race training apparatus according to claim 6, wherein the linear driving device comprises a screw rod (103) disposed at a side of the tread mill (1), a fourth stepping motor (102) for driving the screw rod (103) and a fourth nut block (104) cooperating with the screw rod (103), a guide rail (101) is disposed at a side of the tread mill (1), the screw rod (103) is disposed in the guide rail (101), the fourth nut block (104) is slidably disposed in the guide rail (101), and the bottom of the column (2) is fixed on the fourth nut block (104).

9. The relay race training apparatus according to claim 6, wherein the swinging device (3) comprises an up-down sliding mechanism (301) movable up and down along the column (2), a horizontal rotation mechanism (302) disposed on the up-down sliding mechanism (301) and a vertical rotation mechanism (304) disposed on the horizontal rotation mechanism (302), and the catching and releasing device (4) is connected to an output end of the vertical rotation mechanism (304).

10. The relay race training apparatus according to claim 1, wherein the sensing device is a photoelectric switch (412) disposed at both ends of the holding groove (402) respectively.

11. The relay race training apparatus according to claim 10, wherein a guiding groove (407) and a limiting plate hiding groove (413) are disposed on the holding groove (402), the driving mechanism comprises a third stepping motor (408) disposed at an end of the guiding groove (407) away from the baton (5), a sliding cylinder (405) slidably cooperating with the guiding groove (407) is disposed on the limiting plate (404), and a third nut block (406) thread-connected with the third stepping motor (408) is disposed in the sliding cylinder (405).

12. The relay race training apparatus according to claim 10, wherein the linear driving device comprises a screw rod (103) disposed at a side of the tread mill (1), a fourth stepping motor (102) for driving the screw rod (103) and a fourth nut block (104) cooperating with the screw rod (103), a guide rail (101) is disposed at a side of the tread mill (1), the screw rod (103) is disposed in the guide rail (101), the fourth nut block (104) is slidably disposed in the guide rail (101), and the bottom of the column (2) is fixed on the fourth nut block (104).

13. The relay race training apparatus according to claim 10, wherein the swinging device (3) comprises an up-down sliding mechanism (301) movable up and down along the column (2), a horizontal rotation mechanism (302) disposed on the up-down sliding mechanism (301) and a vertical rotation mechanism (304) disposed on the horizontal rotation mechanism (302), and the catching and releasing device (4) is connected to an output end of the vertical rotation mechanism (304).

14. The relay race training apparatus according to claim 1, wherein a guiding groove (407) and a limiting plate hiding groove (413) are disposed on the holding groove (402), the driving mechanism comprises a third stepping motor (408) disposed at an end of the guiding groove (407) away from the baton (5), a sliding cylinder (405) slidably cooperating with the guiding groove (407) is disposed on the limiting plate (404), and a third nut block (406) thread-connected with the third stepping motor (408) is disposed in the sliding cylinder (405).

15. The relay race training apparatus according to claim 1, wherein the linear driving device comprises a screw rod (103) disposed at a side of the tread mill (1), a fourth stepping motor (102) for driving the screw rod (103) and a fourth nut block (104) cooperating with the screw rod (103), a guide rail (101) is disposed at a side of the tread mill (1), the screw rod (103) is disposed in the guide rail (101), the fourth nut block (104) is slidably disposed in the guide rail (101), and the bottom of the column (2) is fixed on the fourth nut block (104).

16. The relay race training apparatus according to claim 1, wherein the swinging device (3) comprises an up-down sliding mechanism (301) movable up and down along the column (2), a horizontal rotation mechanism (302) disposed on the up-down sliding mechanism (301) and a vertical rotation mechanism (304) disposed on the horizontal rotation mechanism (302), and the catching and releasing device (4) is connected to an output end of the vertical rotation mechanism (304).

17. The relay race training apparatus according to claim 16, wherein the up-down sliding mechanism (301) comprises a sleeving sliding block (3011) slidably cooperating with the column (2), a nut installation groove (207) is disposed at a side of the column (2), a second stepping motor (3014) is disposed in the column (2), an output shaft of the second stepping motor (3014) is disposed toward the linear driving device, and a second nut block (3015) that extends into the nut installation groove (207) to be thread-connected with the second stepping motor (3014) is disposed on the sleeving sliding block (3011).

18. The relay race training apparatus according to claim 17, wherein a circular groove (3012) is disposed at an outer side of the sleeving sliding block (3011), the horizontal rotation mechanism (302) comprises a rotary ring (3021) rotatably disposed in the circular groove (3012), a ring gear (3022) is disposed on the rotary ring (3021), and a motor (3023) for driving the rotary ring (3021) to rotate and a driving gear (3024) that is disposed at an output end of the motor (3023) and engaged with the ring gear (3022) are disposed on the sleeving sliding block (3011).

19. The relay race training apparatus according to claim 18, wherein a connecting rod (303) is further disposed on the rotary ring (3021), the vertical rotation mechanism (304) is disposed at an end of the connecting rod (303) away from the rotary ring (3021), and the catching and releasing device (4) is connected to the output end of the vertical rotation mechanism (304).

* * * * *